US012779315B2

(12) United States Patent
Gee

(10) Patent No.: US 12,779,315 B2
(45) Date of Patent: Nov. 3, 2026

(54) MOBILE SKATE PARK SYSTEM

(71) Applicant: Terry W. Gee, Virginia Beach, VA (US)

(72) Inventor: Terry W. Gee, Virginia Beach, VA (US)

( * ) Notice: Subject to any disclaimer, the term of this patent is extended or adjusted under 35 U.S.C. 154(b) by 265 days.

(21) Appl. No.: 18/581,934

(22) Filed: Feb. 20, 2024

(65) Prior Publication Data

US 2024/0286021 A1 Aug. 29, 2024

Related U.S. Application Data

(60) Provisional application No. 63/448,018, filed on Feb. 24, 2023.

(51) Int. Cl.
*A63C 19/00* (2006.01)

(52) U.S. Cl.
CPC ..... *A63C 19/00* (2013.01)

(58) Field of Classification Search
CPC ..... A63C 2203/10; E01C 13/003
See application file for complete search history.

(56) References Cited

U.S. PATENT DOCUMENTS 5,749,615 A * 5/1998 Itson ..... B60P 3/025 296/26.03

FOREIGN PATENT DOCUMENTS

CH 694522 A5 * 3/2005 ..... A63C 19/10

OTHER PUBLICATIONS

Machine translation of CH 694522 (Year: 2005).*

* cited by examiner

*Primary Examiner* — Brian O Peters
(74) *Attorney, Agent, or Firm* — Williams Mullen; F. Michael Sajovec

(57) ABSTRACT

An exemplary mobile and transportable skate park system is presented. The skate park system may include one or more transportable units configured to transition from a transport configuration to a skate configuration. In the skate configuration, one or more skate movable skate decks may transition from a nested transport configuration to an aligned skate configuration forming all or part of a skate park configuration (for example, a half pipe). In some embodiments, two transport units in the skate configuration may be coupled together to form a half pipe.

18 Claims, 18 Drawing Sheets

MOBILE SKATE PARK SYSTEM

RELATED APPLICATION

The present application claims priority to U.S. Provisional Application No. 63/448,018 filed Feb. 24, 2023, the disclosures of which are hereby incorporated by reference in their entirety.

FIELD OF THE DISCLOSURE

The present disclosure relates generally to a mobile skate park system that may be easily towed to a site, assembled, disassembled for transportation to a different site, and reassembled.

BACKGROUND

Public displays of skateboarding, in-line skating and snowboarding are commonplace, and is often a means for businesses to market their products, particularly shoes and apparel using paid professionals. In order for paid professionals to display such products, they may perform stunts and tricks on ramps assembled one time just for the event. Such one-time ramps often do not conform to competition regulation size. Moreover, assembly is dependent on using often inexperienced carpenters to properly provide a safe ramp. Also, assembly and disassembly may be time-consuming (and expensive) and cumbersome.

There have been modular ramp systems previously proposed such as U.S. Pat. No. 5,749,615 to Itson and U.S. Pat. No. 5,524,310 to Farnen. These modular systems, however, are bulky, not foldable, not easily transported, and do not meet competition standards.

To this end, it would be desirable to provide a half-pipe modular skate park system that may be easily assembled and disassembled, transported preferably using one vehicle, and is compact.

SUMMARY

The present disclosure provides a mobile stake park system including one or more transportable units configurable between a transport configuration and a skate configuration. The transportable units may include a plurality of skate deck portions configured to align together to form a skating surface in the skate configuration. The plurality of skate deck portions may have one or more curved skate deck portions, and one or more flat skate deck portions. The lower curved skate deck portion may include a first arm coupled to a frame of the transportable unit for transitioning the lower curved skate deck portion from an aligned position in the skate configuration to a transport position in the transport configuration. The lower curved skate deck portion may be nested on an upper curved skate deck portion. A lower flat skate deck portion may include a second arm coupled to the lower curved skate deck portion for transitioning the lower flat skate deck portion from an aligned position in the skate configuration to a transport position in the transportation configuration. The lower flat skate deck portion may be disposed proximate a surface of the lower curved skate deck portion.

BRIEF DESCRIPTION OF THE DRAWINGS

These and other features, objects, and advantages of the present invention will become readily apparent from the following description, pending claims, and accompanying sheets of drawings where:

DETAILED DESCRIPTION

The following description includes various embodiments and method of carrying out exemplary embodiments of the present approach. The description is not to be taken in a limiting sense, and is made merely for the purpose of illustrating the general principles of the present approach. It should be appreciated that the various components, configurations, and features described herein may be combined to form other embodiments without departing from the present approach.

Figure 1:
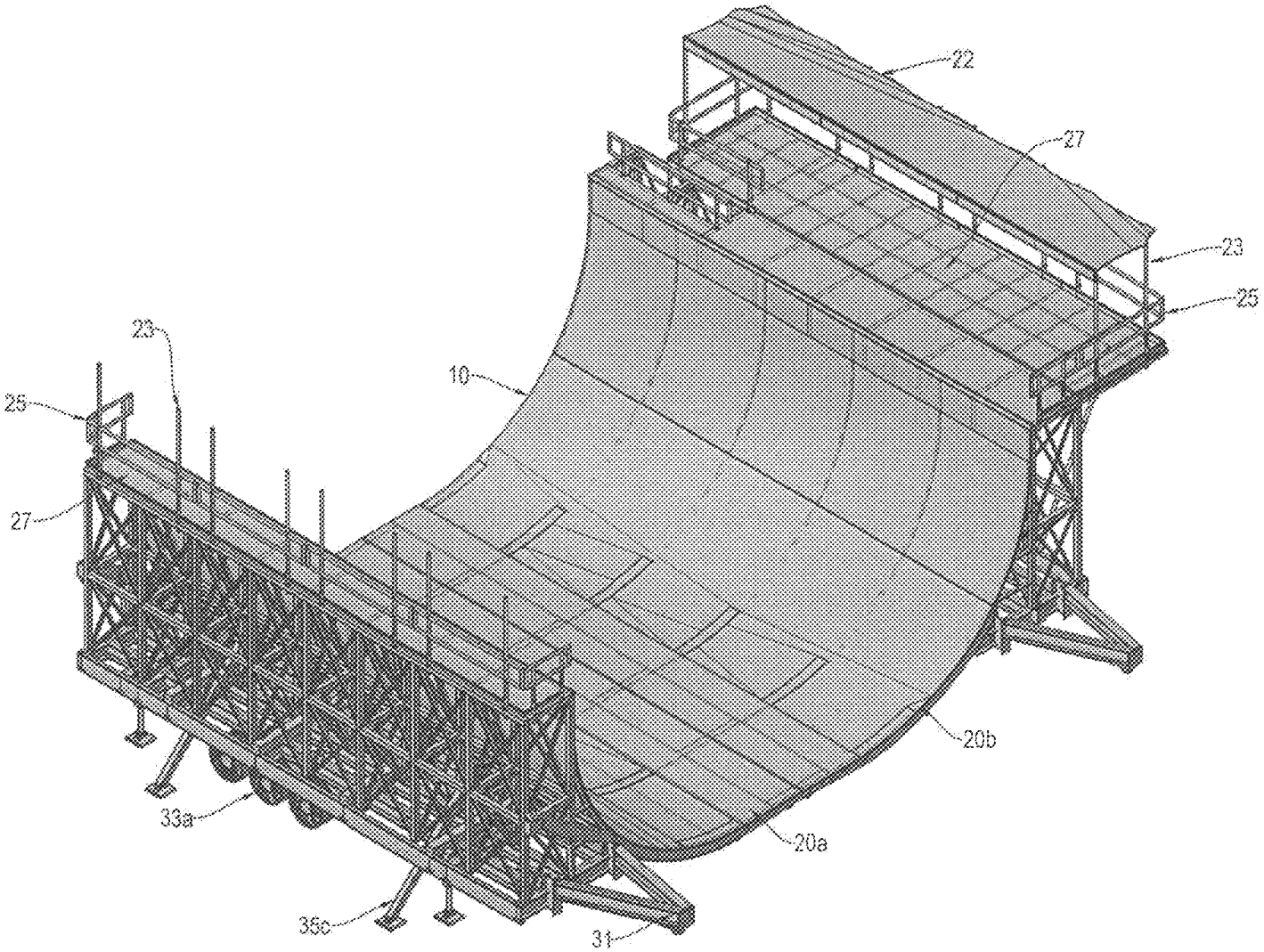
FIG. 1 is a perspective view of the mobile skate park system assembled in a skate configuration and providing a regulation size half pipe.
Figure 2:
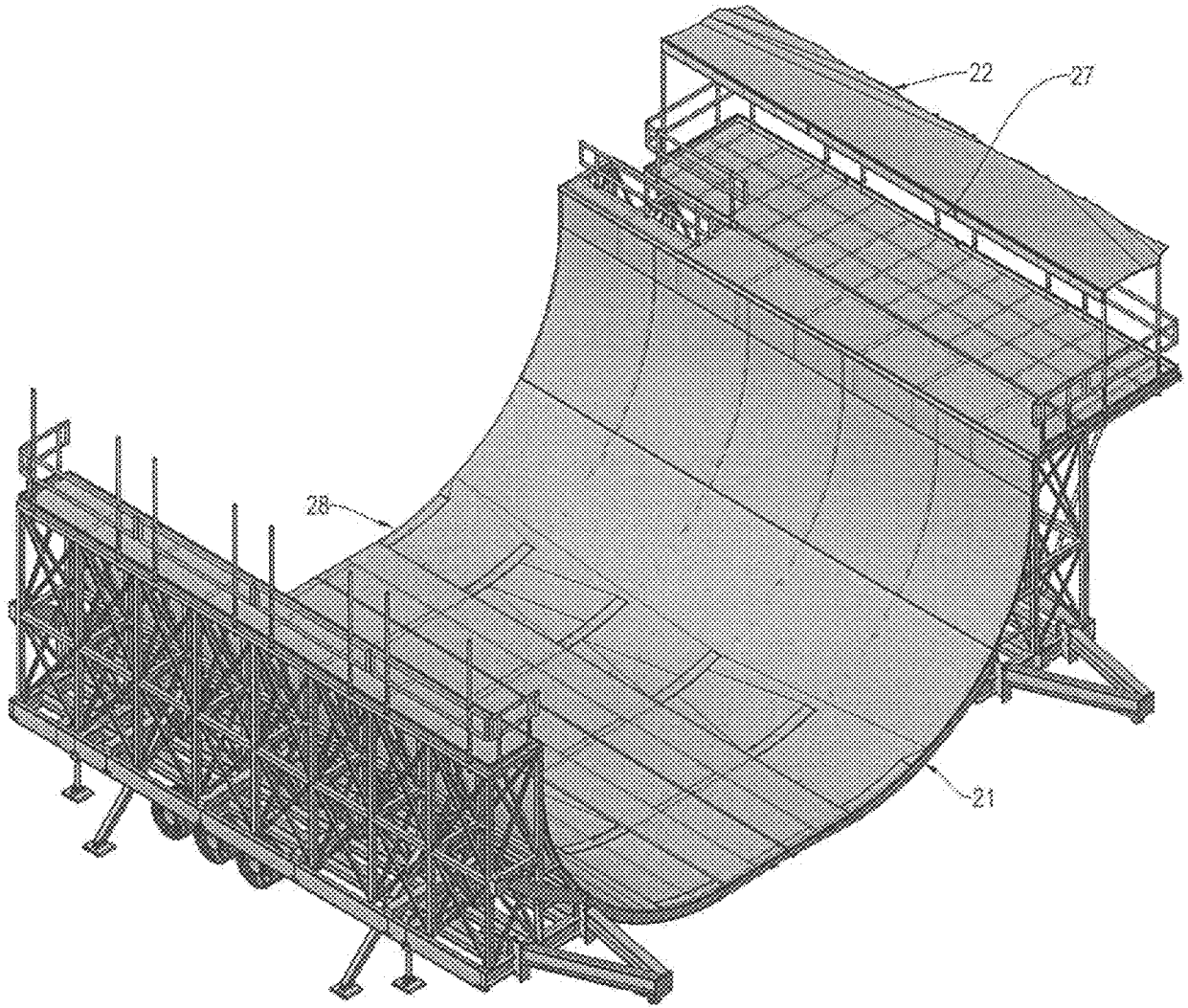
FIG. 2 is a perspective view of the mobile skate park system with a skate deck removed.

Referring to FIG. 1 and FIG. 2, an exemplary mobile skate park system 10 is illustrated. The mobile skate park system 10 may include one or more transportable units 20*a* and 20*b*. The transportable units 20*a*, 20*b* may be configurable between a transport configuration and a skate configuration. The transportable units 20*a* and 20*b* are presented in the skate configuration in FIGS. 1 and 2. The units may be connected together such as using a clamp 29. As shown in FIGS. 1 and 2, the mobile skate park system 10 is in its skate configuration, which may include for example a half-pipe configuration. In the skate figuration, a skate deck 21 may be present.

The mobile skate park system 10 may also include a canopy 22 with support poles 23 and railings 25. In some embodiments, skate participants may stand on a platform 27 prior to a performance and are protected from weather by the canopy 22 and from falling by the railings 25. Typically only one of the transportable units (e.g., 20*b*) has the canopy 22 and platform 27 wherein the opposite transportable unit 20*a* has the railings and a narrow standing platform 27 for allowing participants to briefly stop or rest during performance or use, although unit 20*a* may be configured to include a similar canopy (e.g., canopy 22) if desired. As shown in FIG. 2, when in the transport configuration, in one embodiment the skate deck 21 may be removed and the skate deck frame 28 exposed.

For transporting the mobile skate park system, each transportable unit may include a hitch 31, wheels 33, and one or more ground support braces. The braces may be adjustable such as using hydraulics, such as a lift jack 35.

Figure 3:
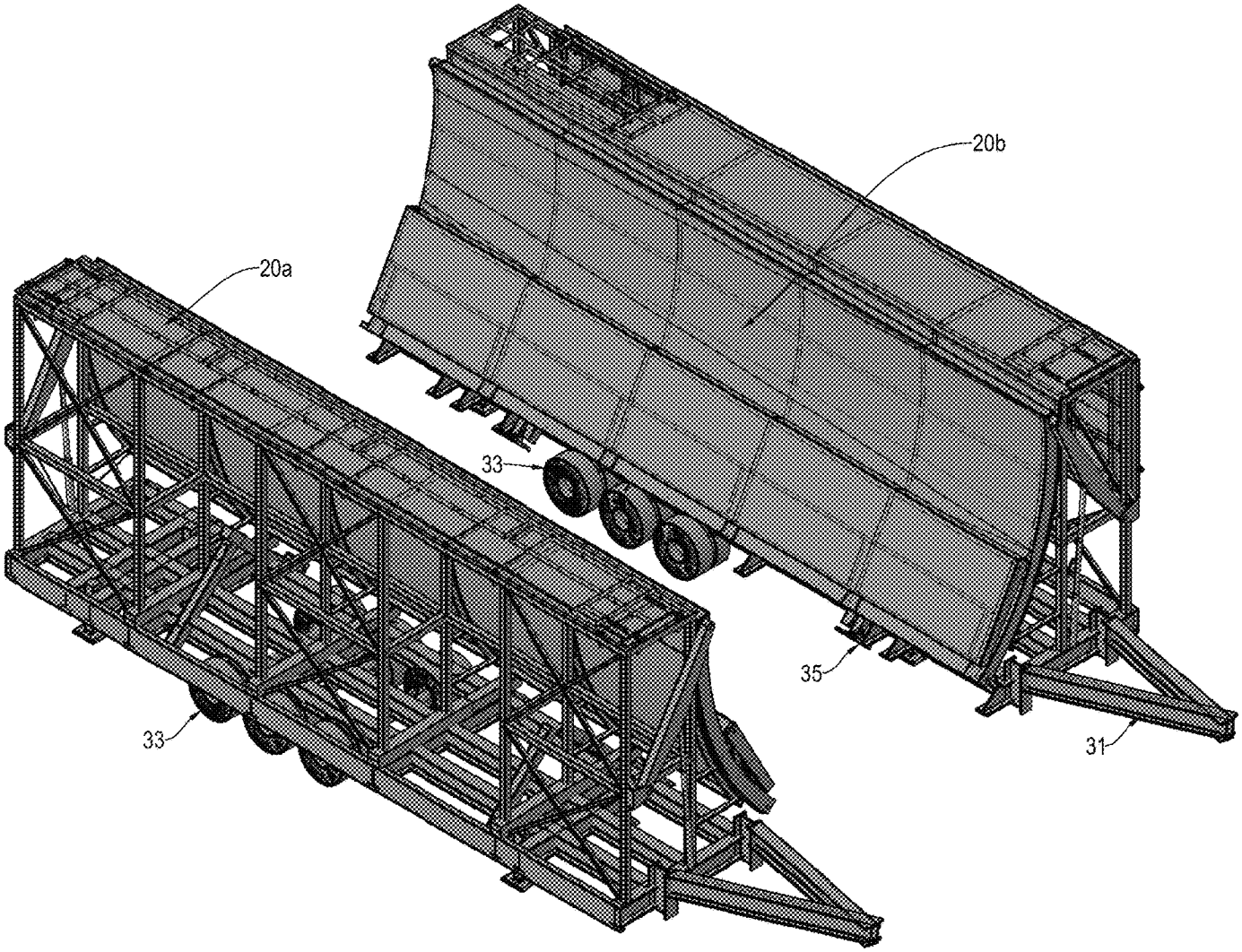
FIG. 3 is a perspective view of the mobile skate park system in a transport configuration for transportation as two transportable units.
Figure 4A:
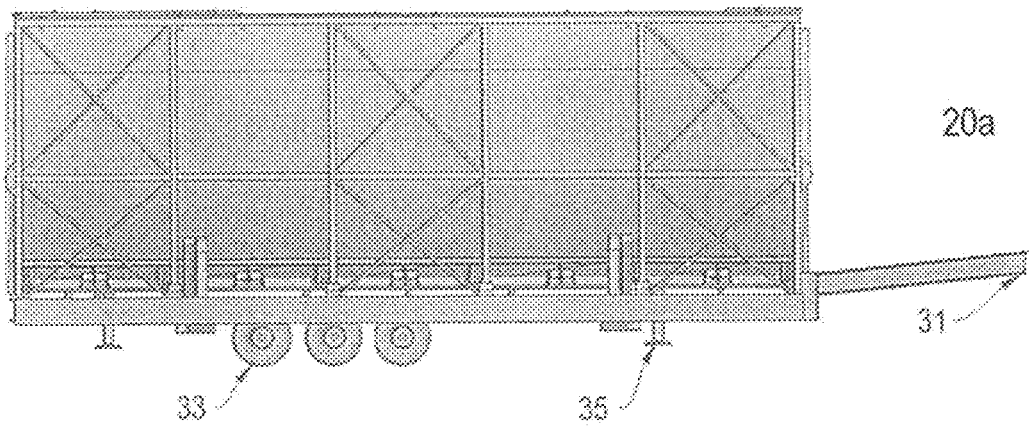
FIGS. 4A and 4B are side views of the transportable units of FIG. 3.
Figure 4B:
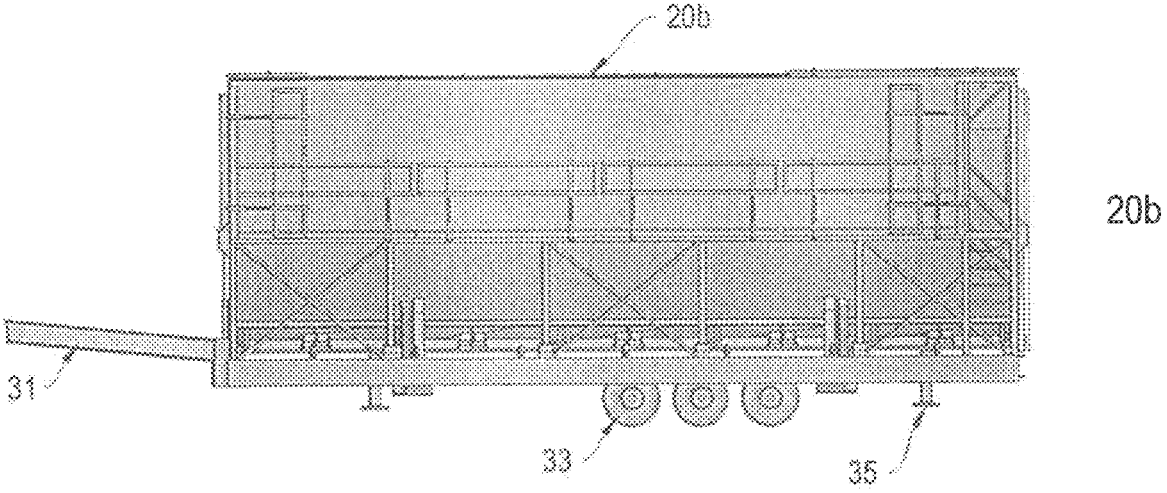
Figure 5:
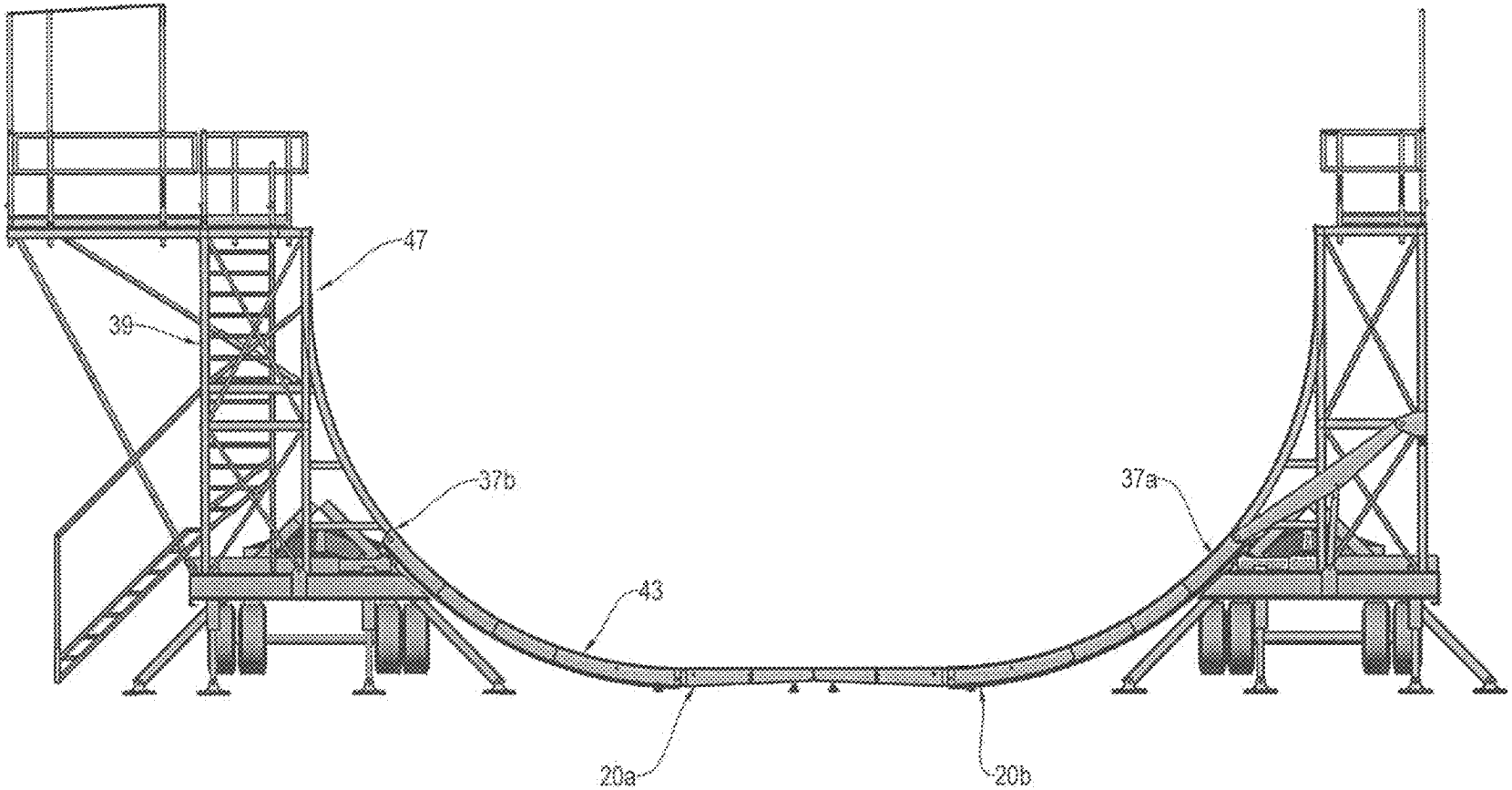
FIG. 5 is a rear view of the mobile skate park system of FIG. 1.

Referring to FIG. 3, FIG. 4A and FIG. 4B, the transportable units 20*a*, 20*b*, are shown in their transport configuration in folded condition. As shown in FIG. 5, the transportable units 20*a*, 20*b* may include a plurality of skate deck portions 37*a*, 37*b* which may be aligned together to form a skating surface when moved to the skate configuration. The transportation units 20*a*, 20*b*, may include a frame 39 to which various elements may be mounted. The skate deck portion may include a moveable lower deck skate portion 43, a moveable center deck skate portion 45, and a fixed upper skate portion 47.

Figure 6A:
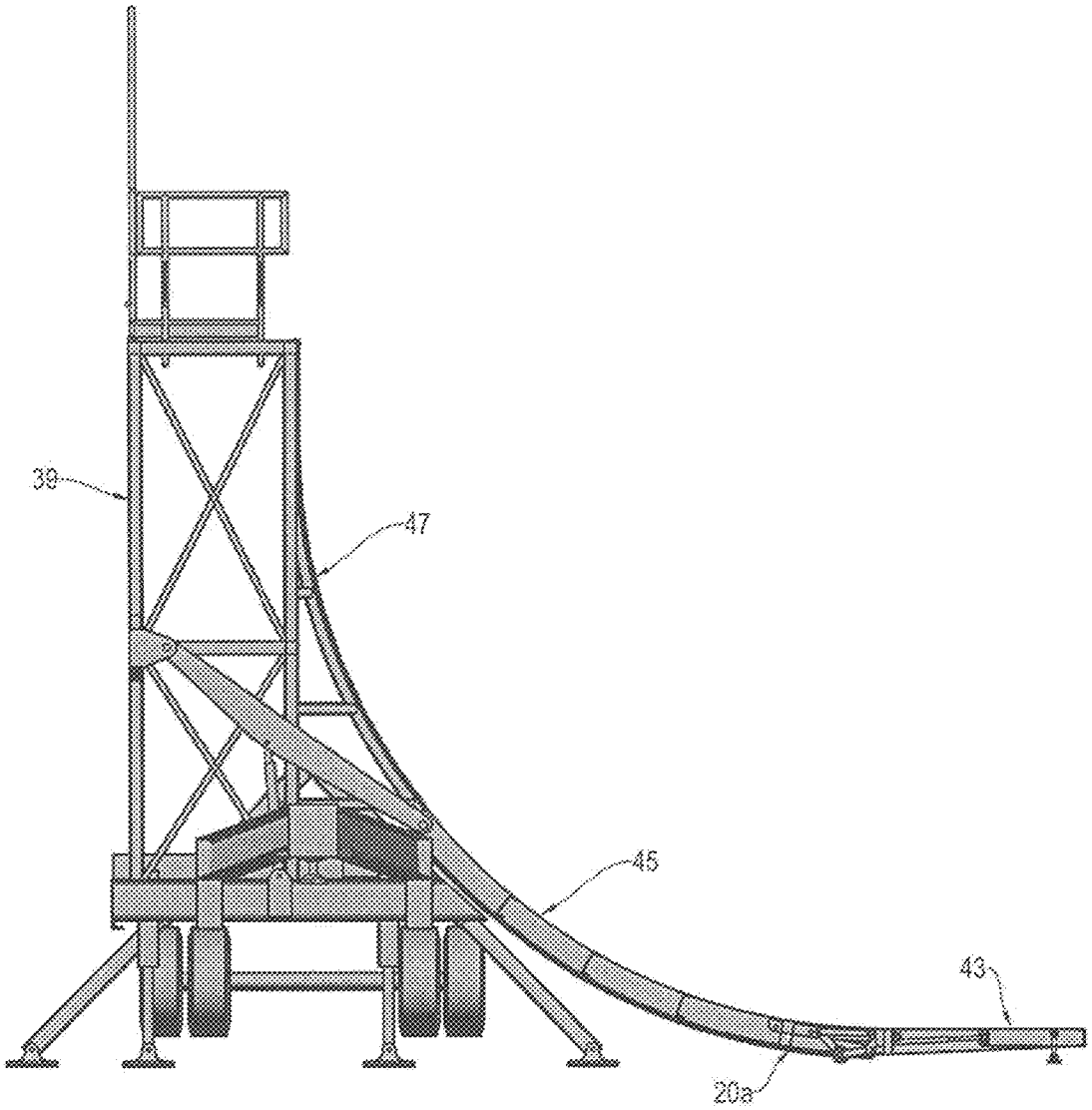
FIGS. 6A-6F are rear views of the transportable unit and illustrate the transitioning from a skate configuration to a transport configuration; and, FIGS. 7A-7F are rear views of the transportable unit, and illustrate an alternative embodiment to FIG. 6A-6F and illustrate the transitioning from a skate configuration to a transport configuration.
Figure 6B:
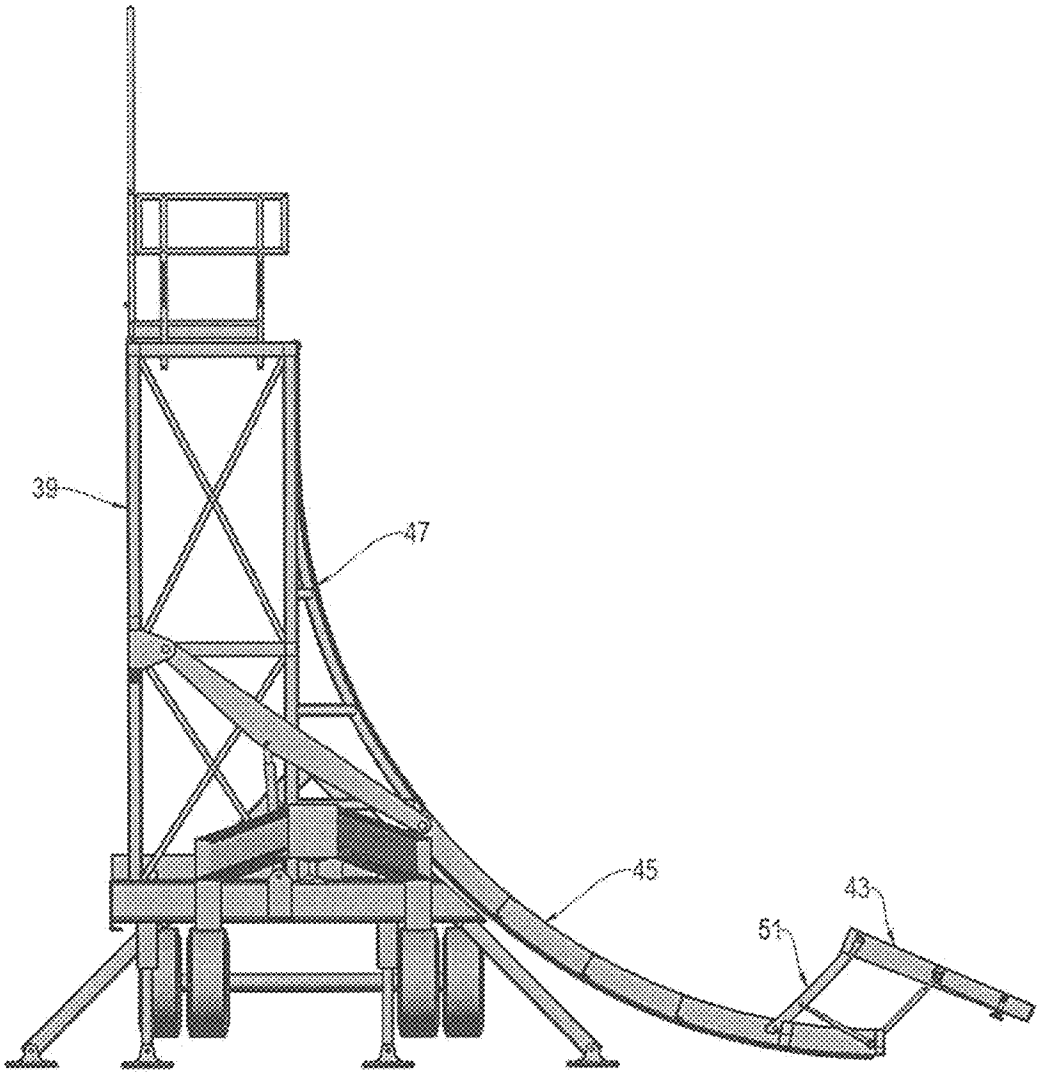
Figure 6C:
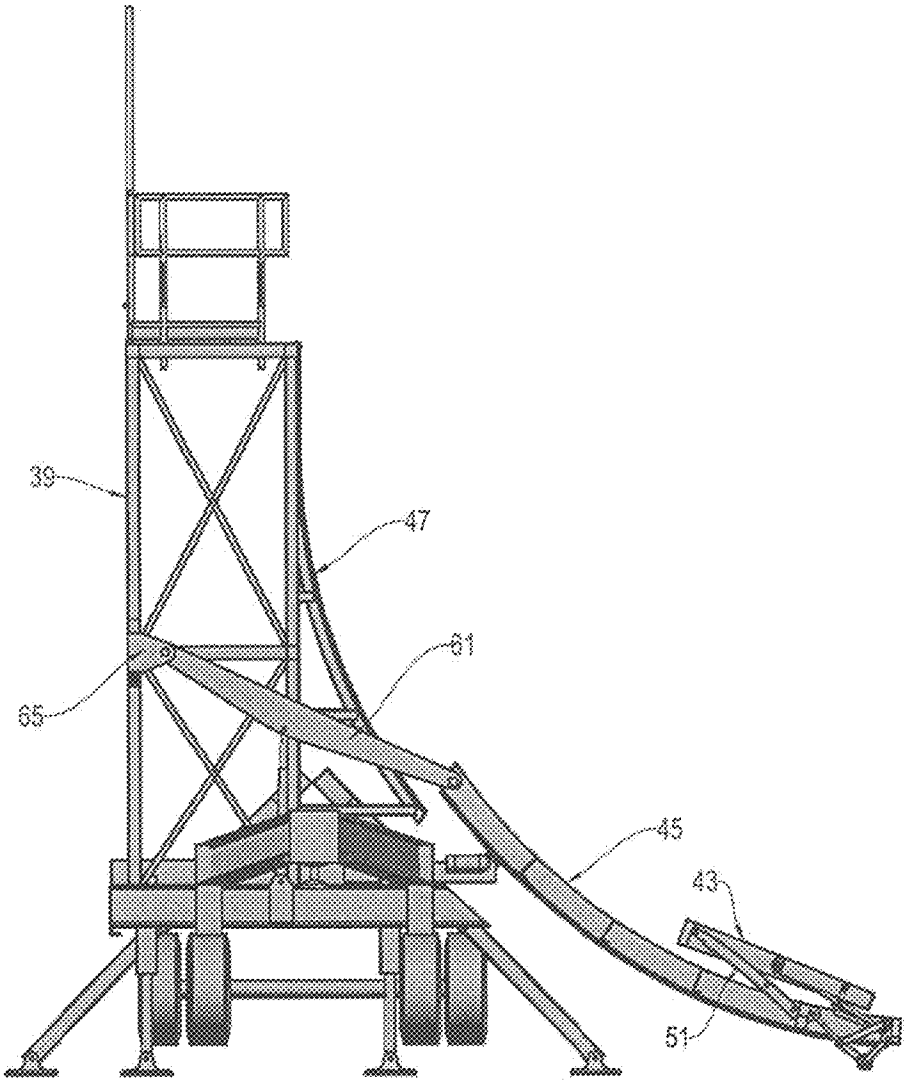
Figure 6D:
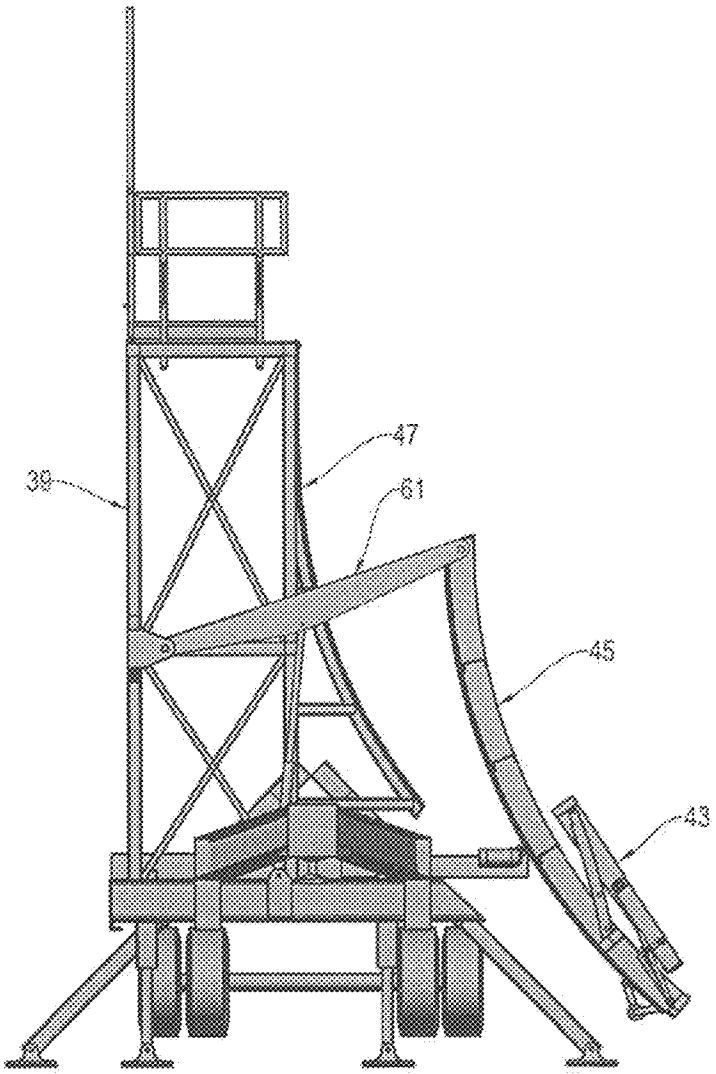
Figure 6E:
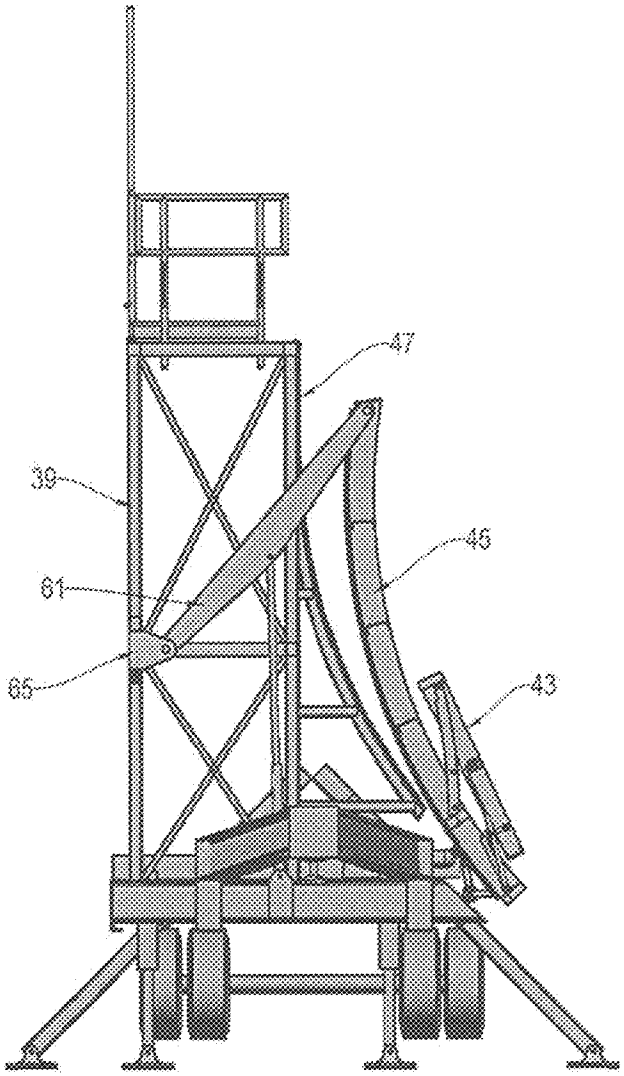
Figure 6F:
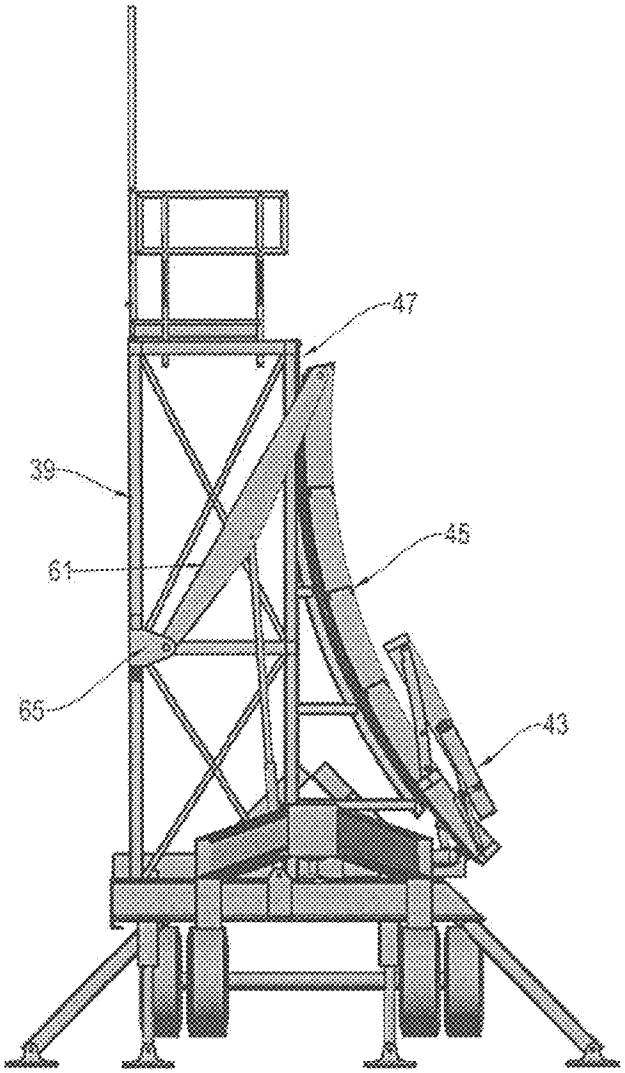

Referring to FIGS. 6A-6F, the operation of converting (i.e., folding) the unit according to another illustrative embodiment is presented. One of the transportable units (e.g., 20*a*) has been separated from the opposite unit and is ready for conversion to the transportable configuration. FIG. 6A shows the transportable unit 20*a* prior to any folding. FIG. 6B illustrates the moveable lower deck skate portion 43 pivoting up. The first arm 51 transitions the lower deck skate portion 43 from the aligned position in the skate configuration shown in FIG. 6A to the transport configuration shown in FIGS. 6B and 6C. The lower skate portion 43 may be nested in the moveable center deck skate portion 45. As shown in FIGS. 6C and 6D, the moveable center deck skate portion 45 may be transitioned (pivoted) from its aligned position in the skate configuration by moving the second arm 61 coupled to a hinge 65 mounted to the frame 39 thereby disengaging center deck skate portion 45 from the upper skate portion 47. As shown in FIG. 6E and FIG. 6F, the center deck skate portion after pivoting may be nested in the fixed upper skate portion 47 and the unit is ready for transportation.

Figure 7A:
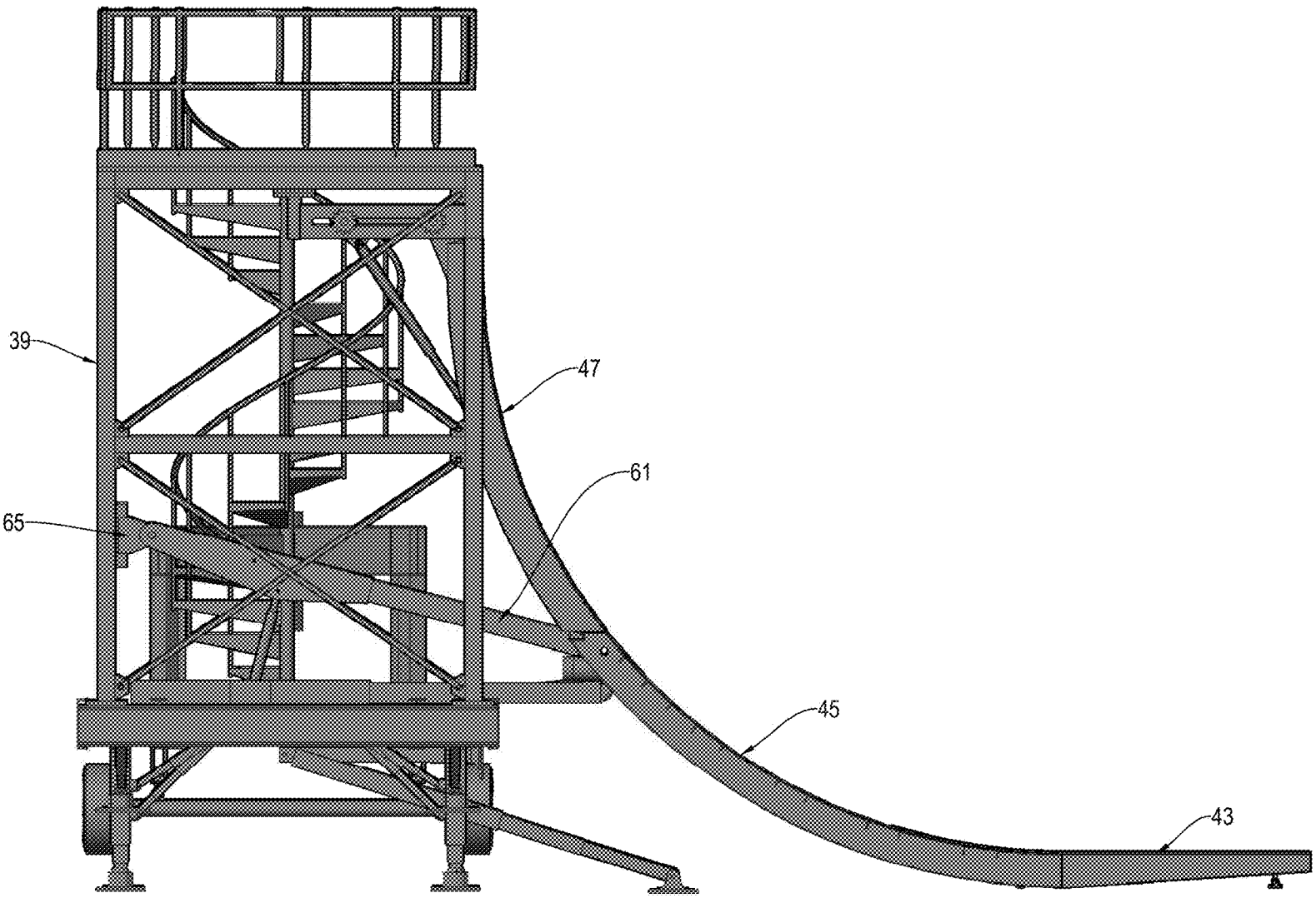
Figure 7B:
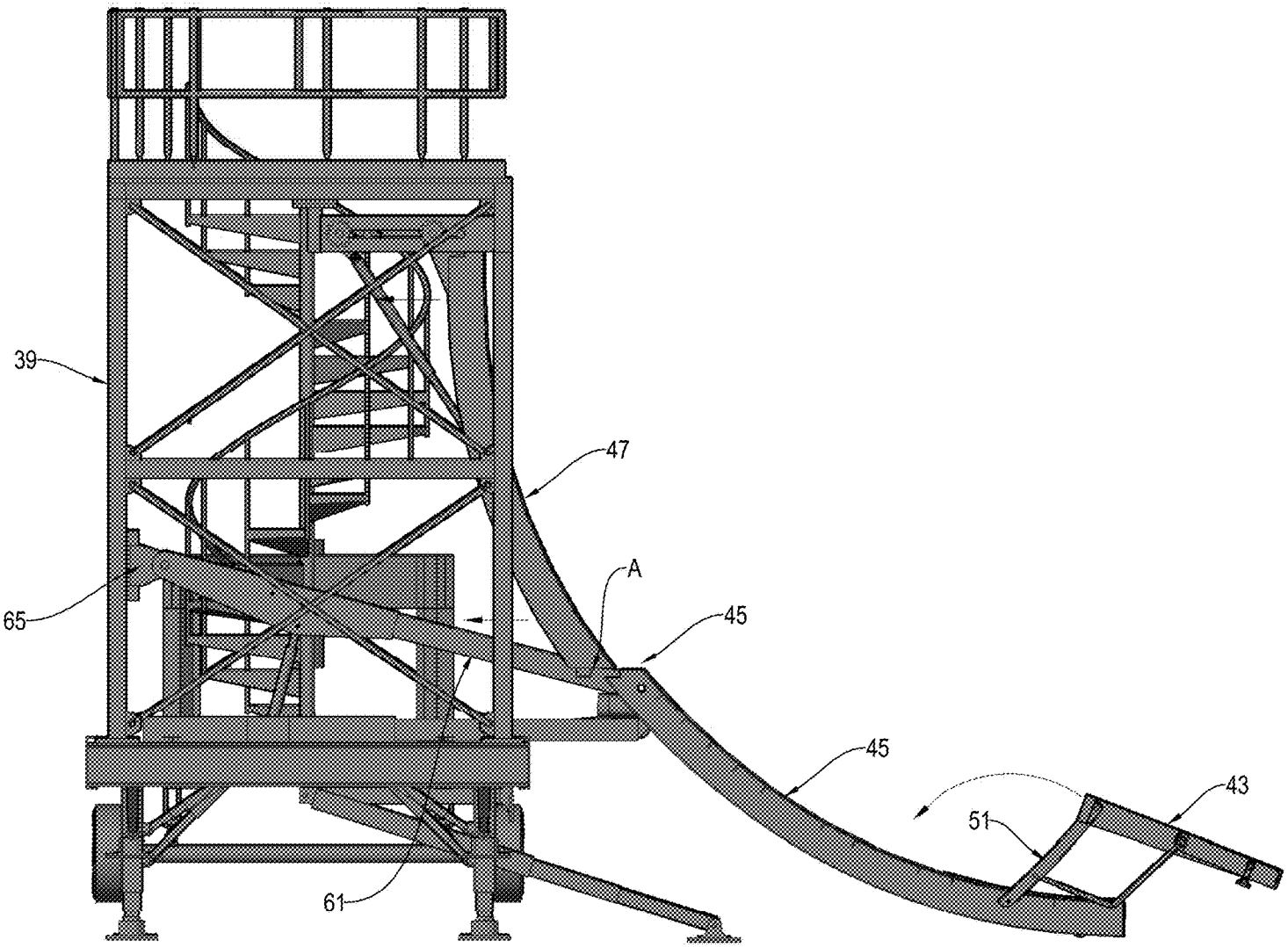
Figure 7C:
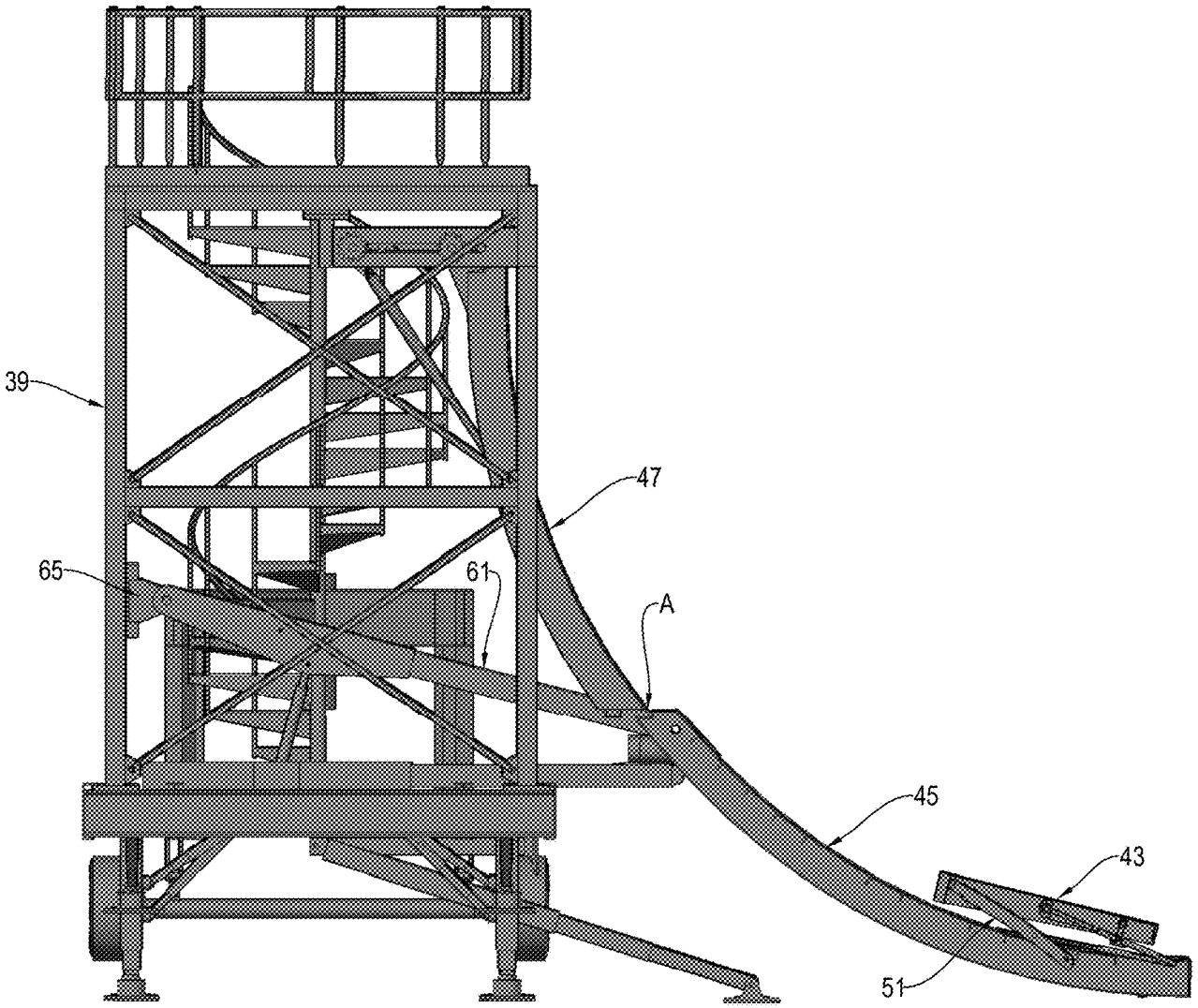
Figure 7D:
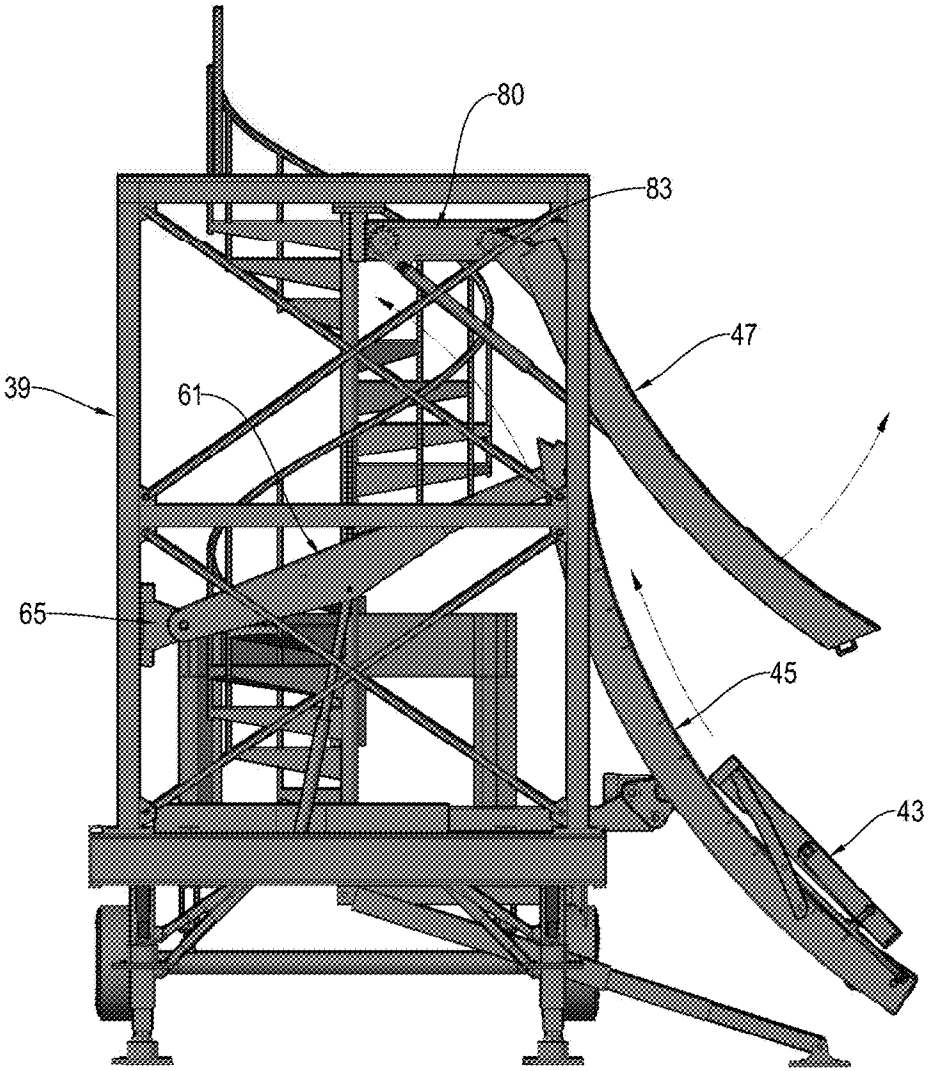
Figure 7E:
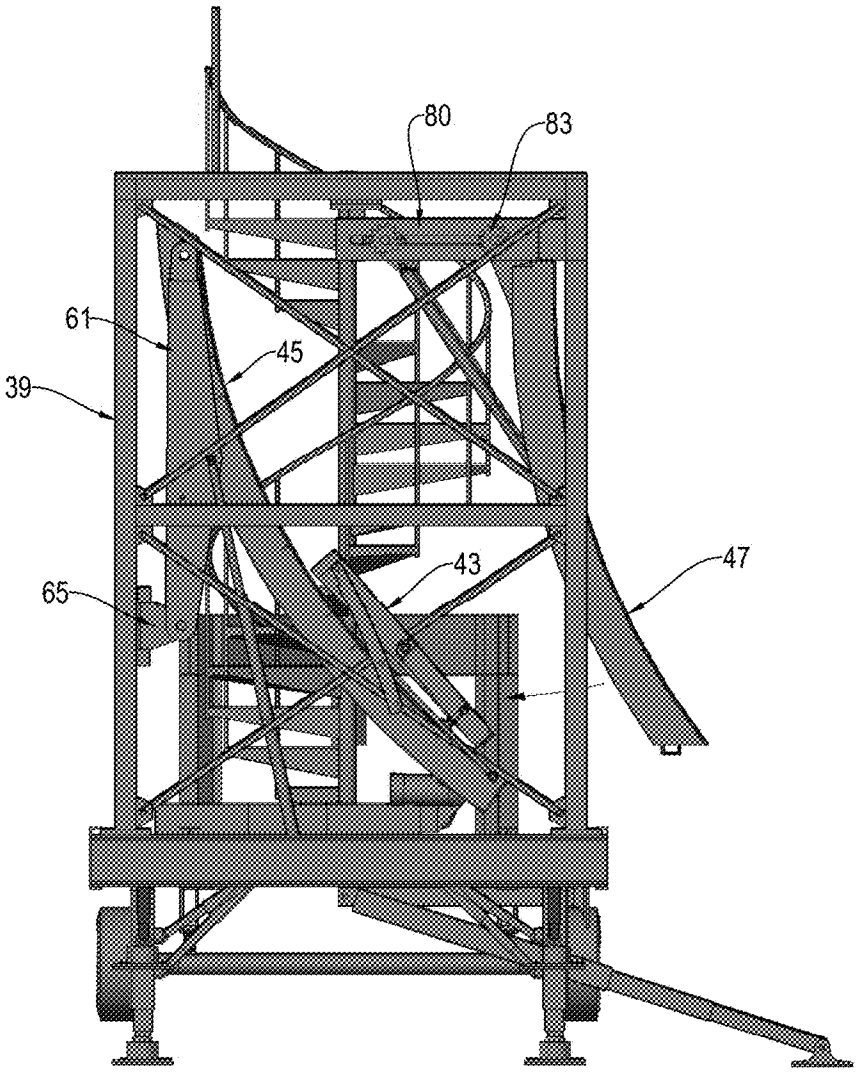
Figure 7F:
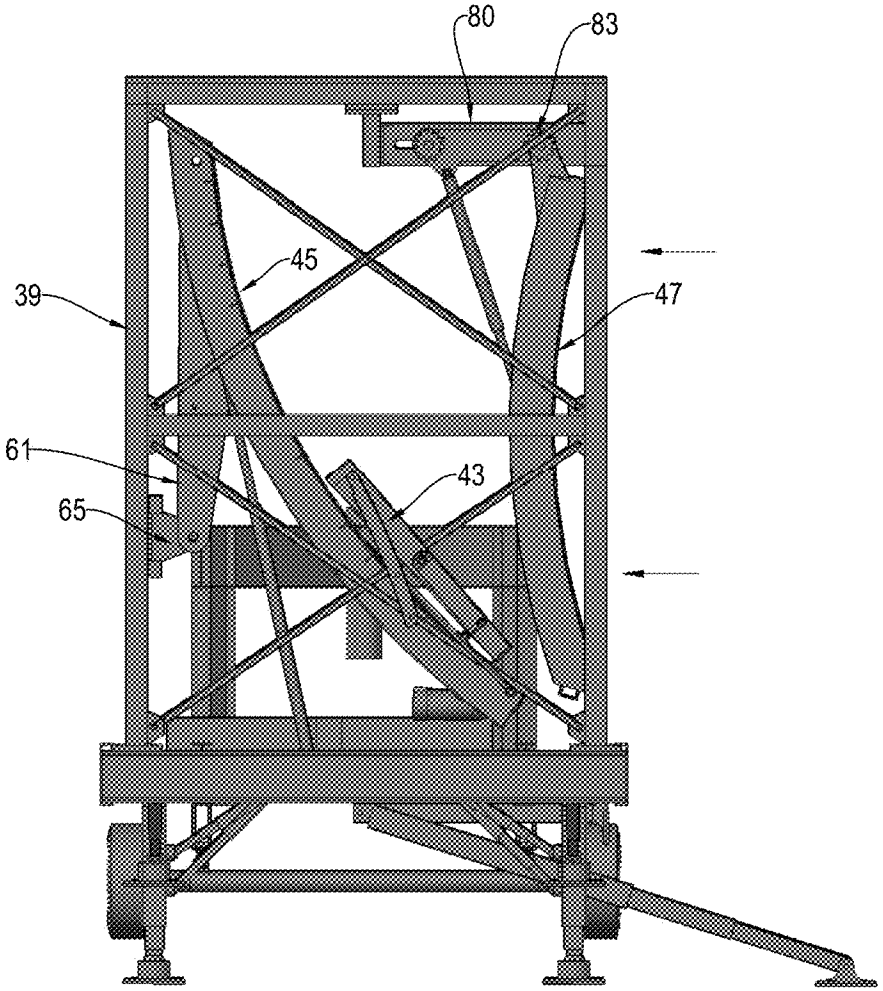

Referring to FIGS. 7A-7F, the operation of converting (i.e., folding) the unit according to another illustrative embodiment is presented. One of the transportable units has been separated from the opposite unit and is ready for conversion to the transportable configuration. FIG. 7A shows the transportable unit 20*a* prior to any folding. FIG. 7B illustrates the moveable lower deck portion 43 pivoting up. As the lower deck skate portion is pivoted up, the moveable center deck skate portion 45 is disconnected from the upper skate portion 47 at pivot point A. The first arm 51 transitions the lower deck skate portion 43 from the aligned position in the skate configuration shown in FIG. 7A to the transport configuration shown in FIGS. 7B and 7C. The lower skate portion 43 may be nested in the moveable center deck skate portion 45. As shown in FIGS. 7C and 7D, the moveable center deck skate portion 45 may be transitioned (pivoted) from its aligned position in the skate configuration by moving the second arm 61 coupled to a hinge 65 mounted to the frame 39. As shown in FIG. 7E, this moves the lower deck skate portion 43 nested in the center deck skate portion 45 to a position inside of the frame 39. As shown in FIGS. 7E and 7F, an upper arm 80 via a hinge mechanism 83 moves the disconnected upper skate portion 47 to a position inward of the frame 39.

The positioning of the moveable lower curved skate portion 43 and the moveable center deck skate portion 45 may be done by mechanical (e.g., various gears and guide wheels), hydraulic or electrical systems, or a combination thereof, the selection of which will be within the skill of one in the art.

Many different arrangements of the various components depicted, as well as components not shown, are possible without departing from the spirit and scope of the present disclosure. Embodiments of the present disclosure have been described with the intent to be illustrative rather than restrictive. Alternative embodiments will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims.

That which is claimed is:

1. A mobile skate park system comprising:

one or more transportable units configurable between a transport configuration and a skate configuration, the transportable units comprising a plurality of skate deck portions configured to align together to form a skating surface in the skate configuration, wherein the plurality of skate deck portions comprise one or more lower and upper curved skate deck portions, and one or more lower flat skate deck portions, wherein a lower curved skate deck portion comprises a first arm coupled to a frame of the transportable unit for transitioning the lower curved skate deck portion from an aligned position in the skate configuration to a transport position in the transport configuration wherein the lower curved skate deck portion is disposed proximate a surface on an upper curved skate deck portion, and further wherein the lower flat skate deck portion comprises a second arm coupled to the lower curved skate deck portion for transitioning the lower flat skate deck portion from an aligned position in the skate configuration to a transport position in the transportation configuration and wherein the lower flat skate deck portion is nested proximate a surface of the lower curved skate deck portion.

2. The system of claim 1, further comprising one or more ground support braces for supporting the transportable unit in the skate configuration.

3. The system of claim 2 wherein the braces are adjustable.

4. The system of claim 2 wherein the braces are hydraulically adjustable.

5. The system of claim 1 further comprising a hydraulic system for operatively moving the first arm or the second arm.

6. The system of claim 1 further comprising a platform disposed above the plurality of deck portions in the skate configuration.

7. The system of claim 1 wherein two transportable units in the skate configuration are coupled together along an end of the flat skate deck portion of each unit.

8. The system of claim 7 wherein the two transportable units are coupled using clamps.

9. The system of claim 1 wherein the one or more transportable units comprise trailers configured for towing behind a vehicle.

10. A mobile skate park system comprising:

one or more transportable units configurable between a transport configuration and a skate configuration, the transportable units comprising a frame and a plurality of skate deck portions configured to align together to form a skating surface in the skate configuration, wherein the plurality of skate deck portions comprise one or more lower and upper curved skate deck portions, and one or more lower flat skate deck portions, wherein a lower curved skate deck portion comprises a first arm coupled to the frame of the transportable unit for transitioning the lower curved skate deck portion from an aligned position in the skate configuration to a transport position inside the frame in the transport configuration wherein the lower curved skate deck portion is disposed proximate on an upper curved skate deck portion, and further wherein a lower flat skate deck portion comprises a second arm coupled the frame and to the lower curved skate deck portion for transitioning the lower flat skate deck portion from an aligned position in the skate configuration to a transport position inside the frame in the transportation configuration wherein the lower flat skate deck portion is nested proximate a surface of the lower curved skate deck portion.

11. The system of claim 10, further comprising one or more ground support braces for supporting the transportable unit in the skate configuration.

12. The system of claim 11 wherein the braces are adjustable.

13. The system of claim 11 wherein the braces are hydraulically adjustable.

14. The system of claim 10 further comprising a hydraulic system for operatively moving the first arm or the second arm.

15. The system of claim 10 further comprising a platform disposed above the plurality of deck portions in the skate configuration.

16. The system of claim 10 wherein two transportable units in the skate configuration are coupled together along an end of the flat skate deck portion of each unit.

17. The system of claim 16 wherein the two transportable units are coupled using clamps.

18. The system of claim 16 wherein the one or more transportable units comprise trailers configured for towing behind a vehicle.

* * * * *